US010224698B1

(12) United States Patent
Jacques

(10) Patent No.: US 10,224,698 B1
(45) Date of Patent: Mar. 5, 2019

(54) IGNITION WIRE SPARK PLUG CONNECTOR

(71) Applicant: ETCO Incorporated, Warwick, RI (US)

(72) Inventor: Edward H Jacques, Sarasota, FL (US)

(73) Assignee: ETCO, Inc., Warwick, RI (US)

( * ) Notice: Subject to any disclaimer, the term of this patent is extended or adjusted under 35 U.S.C. 154(b) by 0 days.

(21) Appl. No.: 15/885,929

(22) Filed: Feb. 1, 2018

(51) Int. Cl.

| | |
|---|---|
| ***H01R 4/18*** | (2006.01) |
| ***H01R 13/11*** | (2006.01) |
| ***H01R 13/18*** | (2006.01) |
| ***H01R 24/20*** | (2011.01) |
| ***H01T 13/04*** | (2006.01) |

(52) U.S. Cl.
CPC ..... *H01T 13/04* (2013.01); *H01R 13/111* (2013.01); *H01R 13/18* (2013.01); *H01R 24/20* (2013.01); *H01R 4/184* (2013.01)

(58) Field of Classification Search
CPC ..... H01T 13/04; H01R 11/281; H01R 13/111; H01R 13/18; H01R 24/20; H01R 4/184; H01R 2101/00
USPC ..... 439/125, 848
See application file for complete search history.

(56) References Cited

U.S. PATENT DOCUMENTS

| | | | | | |
|---|---|---|---|---|---|
| 2,024,814 | A * | 12/1935 | Bell | H01T 13/04 | 439/218 |
| 2,553,083 | A | 5/1951 | Elliot | | |
| 3,364,459 | A | 1/1968 | Schiller | | |
| 3,587,723 | A | 6/1971 | Norback | | |
| 3,995,929 | A * | 12/1976 | Ghirardi | H01R 13/35 | 439/218 |
| 4,009,924 | A | 2/1977 | Bungo et al. | | |
| 4,209,221 | A * | 6/1980 | Chupak | H01R 24/20 | 439/848 |
| 4,284,322 | A | 8/1981 | Keller | | |
| 4,758,189 | A * | 7/1988 | Draxler | H01R 24/20 | 439/125 |
| 4,846,736 | A | 7/1989 | Powers et al. | | |
| 4,886,473 | A * | 12/1989 | Germ | H01R 13/18 | 439/847 |
| 5,951,308 | A * | 9/1999 | Rea | H01R 13/18 | 439/125 |
| 7,699,670 | B1 | 4/2010 | Jacques et al. | | |
| 8,562,371 | B2 * | 10/2013 | Biesse | H01R 4/4854 | 439/352 |
| 2016/0308304 | A1 * | 10/2016 | Miller | H01R 11/282 | |

* cited by examiner

*Primary Examiner* — Edwin A. Leon
*Assistant Examiner* — Oscar C Jimenez
(74) *Attorney, Agent, or Firm* — Altman & Martin; Steven K Martin

(57) ABSTRACT

An ignition wire spark plug connector comprising a jack and a wire attachment. The wire attachment is adapted to electrically attach to a wire. The jack is comprised of a barrel with a closed end. The barrel is generally cylindrical with a central space that receives the spark plug terminal through an open end. Dimples in the barrel extend into the central space. The dimples are located to force at least four points of contact between the jack and the spark plug terminal.

9 Claims, 5 Drawing Sheets

IGNITION WIRE SPARK PLUG CONNECTOR

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical connectors, more particularly, to connectors for connecting an ignition wire to a spark plug terminal.

2. Description of the Related Art

The connector of an ignition wire of an internal combustion engine attaches to a spark plug or distributor cap terminal. The typical ignition wire connector has an attachment at one end to attach to the ignition wire. The other end that connects to the spark plug or distributor cap is a generally cylindrical barrel. A spring clip with dimples snaps into through holes in the barrel wall. The dimples snap into the center of the hour-glass shaped spark plug terminal. The spring clip applies a radial compression force to the spark plug terminal that helps to retain the connector on the spark plug terminal and to maintain the cylindrical shape. An insulating boot fits over the connector to protect the connector and spark plug terminal.

Producing these connectors is costly. The barrel needs to be pierced for the through holes and the spring clip needs to be stamped, heat treated, sometimes plated, and then assembled to the barrel.

In addition, the through holes become elongated as the barrel is cupped or drawn up. As a result, the spring clip is assembled in a range of positions on the barrel, both vertically and radially. The purpose of this assembly is to keep the clip from falling off the terminal and keep the terminal from falling off the spark plug, not to keep the terminal in a particular position on the spark plug.

Also, during the ignition wire manufacturing process, when the insulating boot is installed over the connector, the spring clip can become dislodged and/or dislocated.

There exist connectors that offer retention without a spring clip. The majority of these connectors have a single dimple on one side of the barrel, typically located to target the smaller diameter of the spark plug terminal. These designs cause extreme flex of the barrel and do not always maintain an uninterrupted connection with the spark plug.

BRIEF SUMMARY OF THE INVENTION

The ignition wire spark plug connector of the present invention has a jack and a wire attachment. The wire attachment attaches the connector to an ignition wire by any of the different ways know in the art.

The jack has a barrel with a closed end and an open end. An end cap closes the closed end. A paraxial seam permit the barrel to expand in diameter.

The barrel has a pair of inwardly-extending dimples. The dimples are not directly opposite each other. They are in the range of from 140° to 170° around the barrel from each other. Optionally, the dimples are placed symmetrically around the barrel from the seam.

The barrel and the diameter of the circle formed by the two dimples are sized to fit onto the spark plug terminal such that the barrel expands slightly at the seam to provide an inward radial pressure, as described below. When the jack is installed on a spark plug terminal, the dimples snap onto the spark plug terminal taper. The distance from the dimples to the barrel closed end is set to target the taper just below the bulge/taper junction. To that end, the distance from the dimples to the closed end is slightly larger than the distance from the spark plug terminal top to the bulge/taper junction. The dimples are a distance from 10 mils to 40 mils below the bulge so that they rest on the taper just below the junction.

Because the diameter of the dimple circle is smaller than the diameter at the location on the taper that the dimples contact, the barrel cannot fully close when installed on the spark plug terminal. This results in constant pressure between the jack and the spark plug terminal at four locations: the dimples against the taper, the closed end against the terminal top, and the bulge against the barrel.

The connector of the present invention is simpler and more economical to manufacture and provides an improved electrical connection that the clipped connectors of the prior art. While prior art connectors terminals may stay attached to the spark plug terminal they do not offer the continuous pressure of the present connector or the four points of contact.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 7:
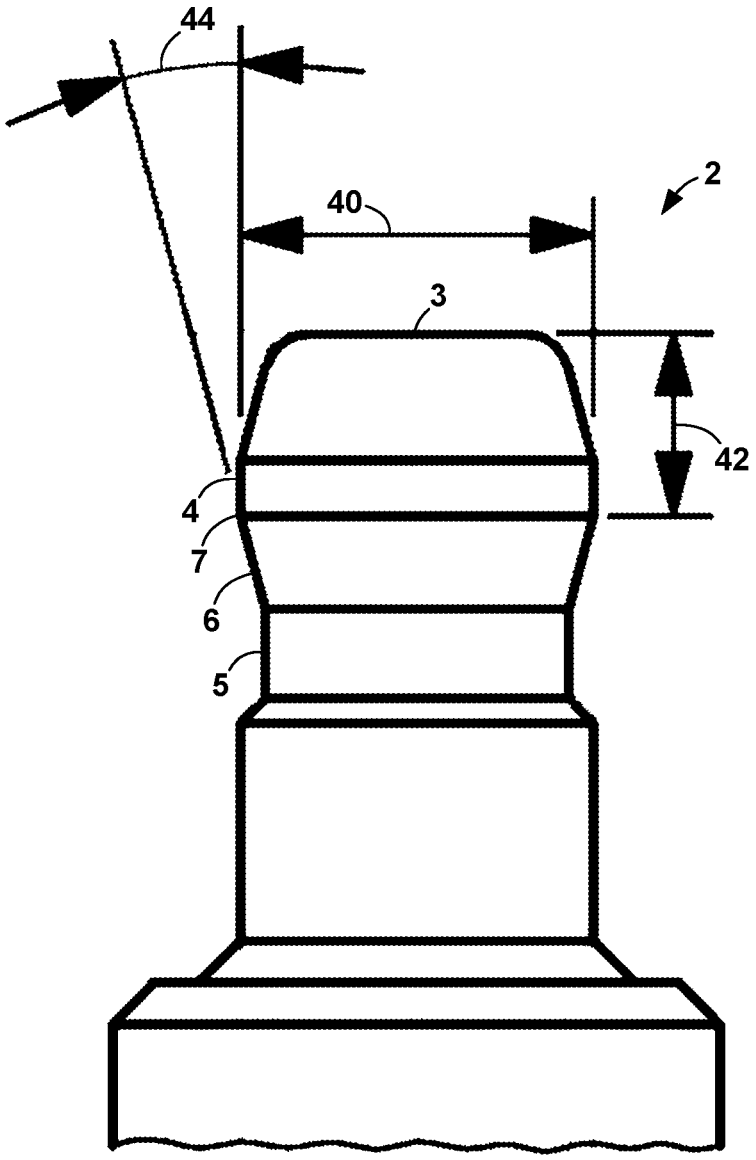
FIG. 7 is a side view showing the parameters of the spark plug terminal.

Spark plug terminals 2 have a round cross-section with standardized parameters, identified in International Standard ISO 14508. The three parameters most important to the present invention are shown in FIG. 7. The diameter D 40 of the terminal bulge 4 is 252±4 mils (6.4±0.1 mm). The height H 42 from the junction 7 of the bulge 4 and taper 6 to the top surface 3 is 126±20 mils (3.2±0.5 mm). The angle A 44 of the taper 6 from the bottom of the bulge 4 to the waist 5 is 15°±3°.

FIGS. 1-6 show the ignition wire spark plug connector 10 of the present invention. The connector 10 has a body 18 with two parts, a jack 12 and a wire attachment 14. The body 18 is composed of an electrically conductive material, typically metallic, such as steel, stainless steel, aluminum and aluminum alloys and copper and copper alloys, the most common being brass.

The wire attachment 14 is designed to attach the connector 10 to an ignition wire 16. Different wire attachment methods are known in the art. The wire attachment 14 illustrated in the figures is a crimp of a style commonly used in the industry for attaching a connector to the end of a wire. This is merely one form of wire attachment 14. The present invention contemplates that any type of wire attachment can be used.

Figure 1:
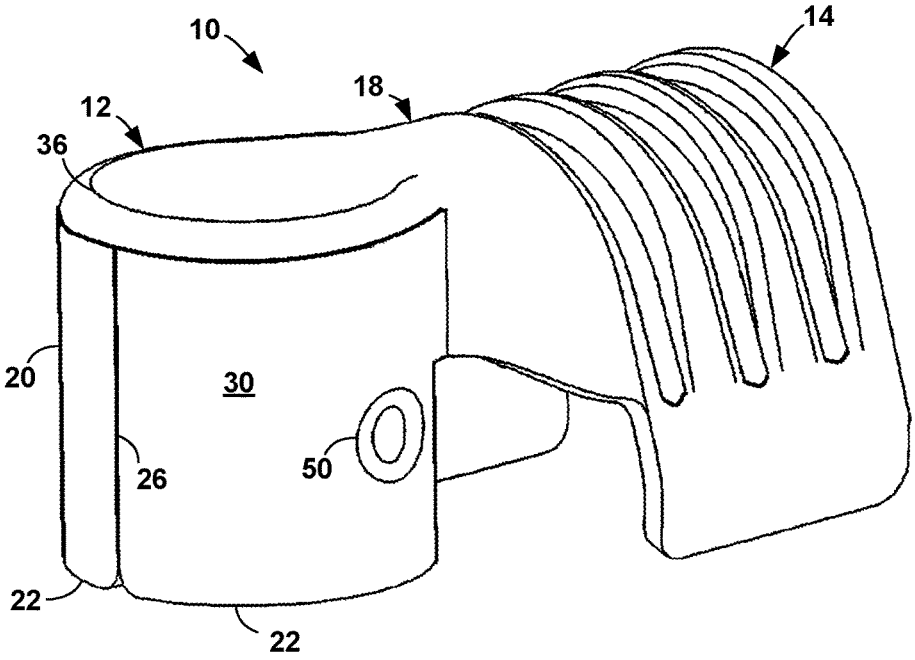
FIG. 1 is a top isometric view of a 90° connector of the present invention.
Figure 2:
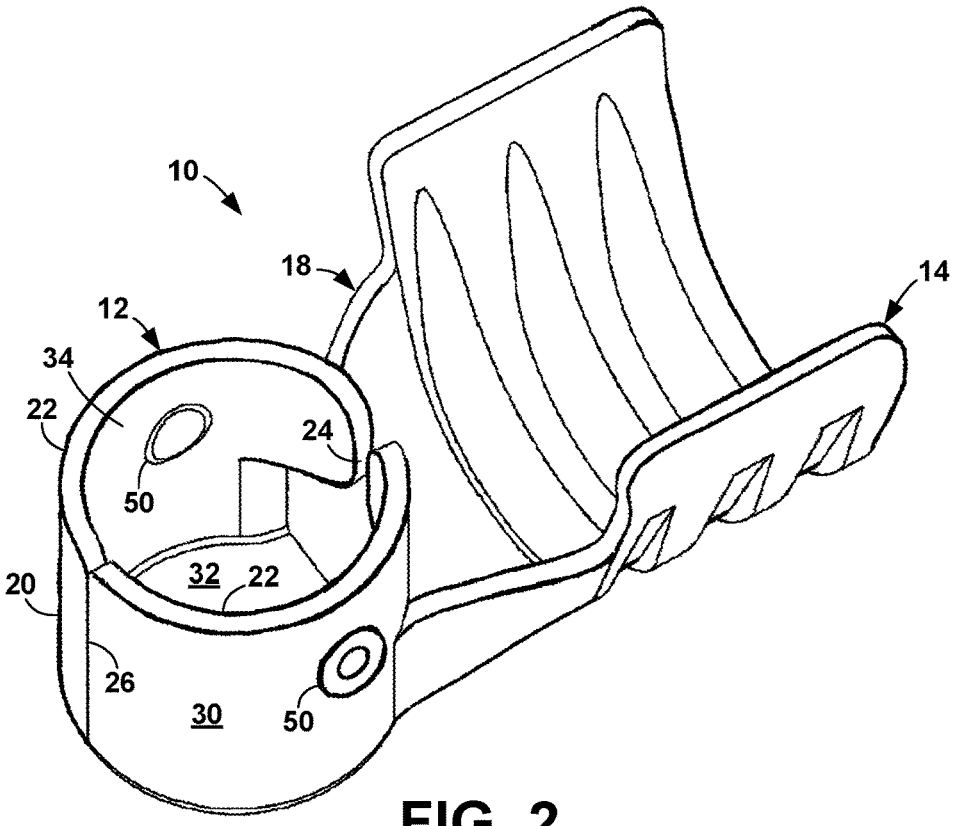
FIG. 2 is a bottom isometric view of the connector of FIG. 1.
Figure 3:
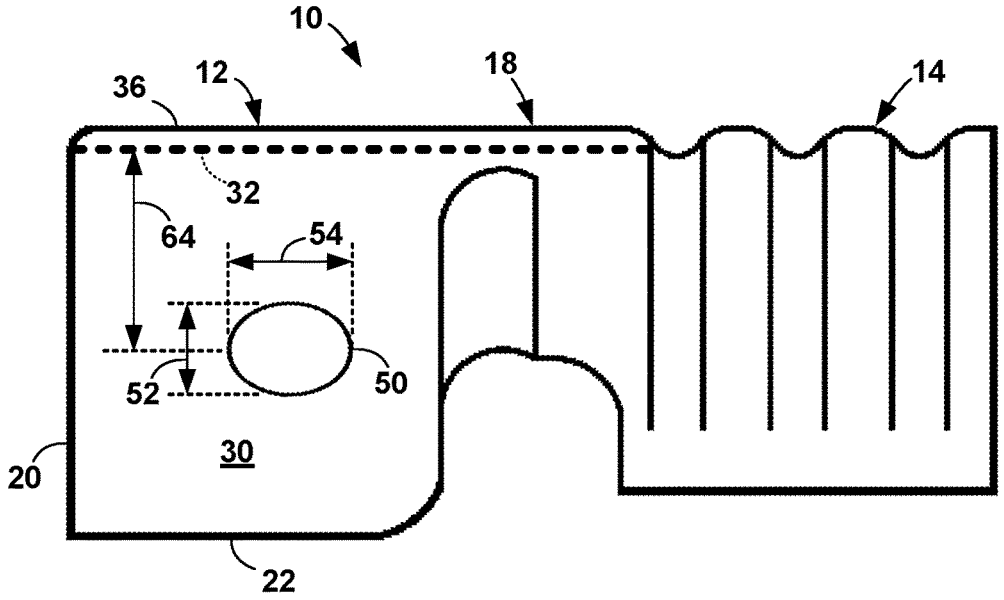
FIG. 3 is a side view of the connector of FIG. 1.
Figure 4:
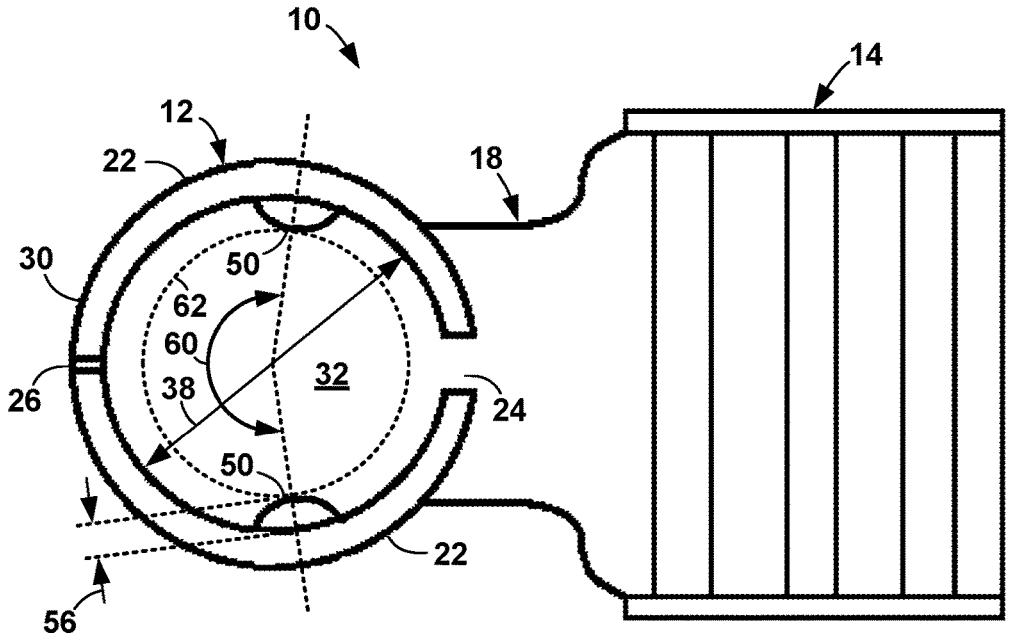
FIG. 4 is a bottom view of the connector of FIG. 1.
Figure 5:
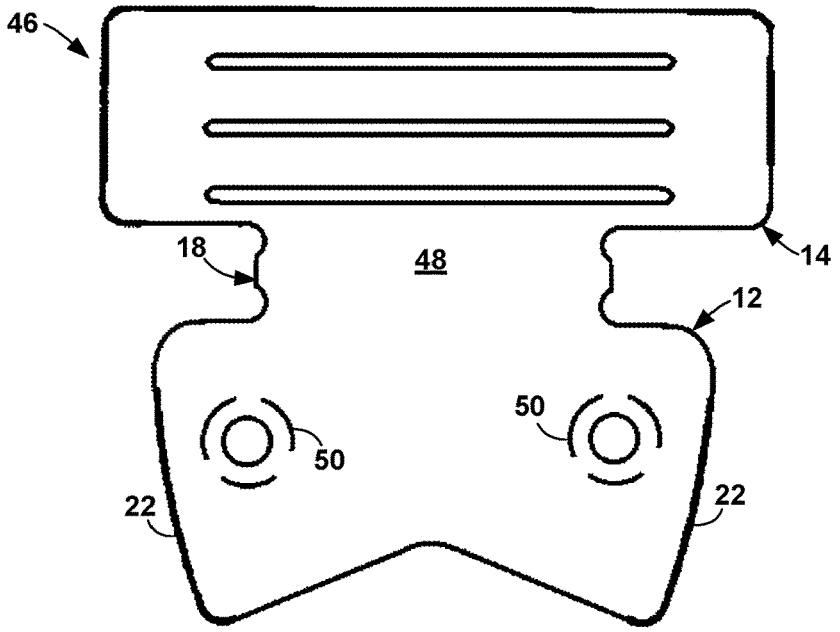
FIG. 5 is a view of the blank of the connector of FIG. 1 prior to bending.

The jack 12, which attaches to the spark plug terminal 2 or distributor cap, has a barrel 20 with a closed end 32 and an open end 34. An end cap 36 closes the closed end 32. The connector blank 46 has a pair of opposed wings 22 extending from the center section 48 of the body 18, as shown in FIG. 5. The wings 22 are bent at right angles from the center section 48 and then curled into a cylinder to form the barrel 20 with a wall 30 and a central space 28 with a diameter 38 that expands when installed on the spark plug terminal 2.

In the figures, the barrel 20 is not a complete cylinder, but has a paraxial gap 24 toward the wire attachment 14 and a paraxial seam 26 opposite the paraxial gap 24. The gap 24 and seam 26 provide the expandable diameter 38. The present invention contemplates that the barrel 20 can be a complete cylinder with at least one paraxial seam 26 to provide the expandable diameter 38. Alternatively, the expandable diameter 38 can be provided by any other manner known in the art.

The center section 48 of the body 18 forms the end cap 36.

Figure 6:
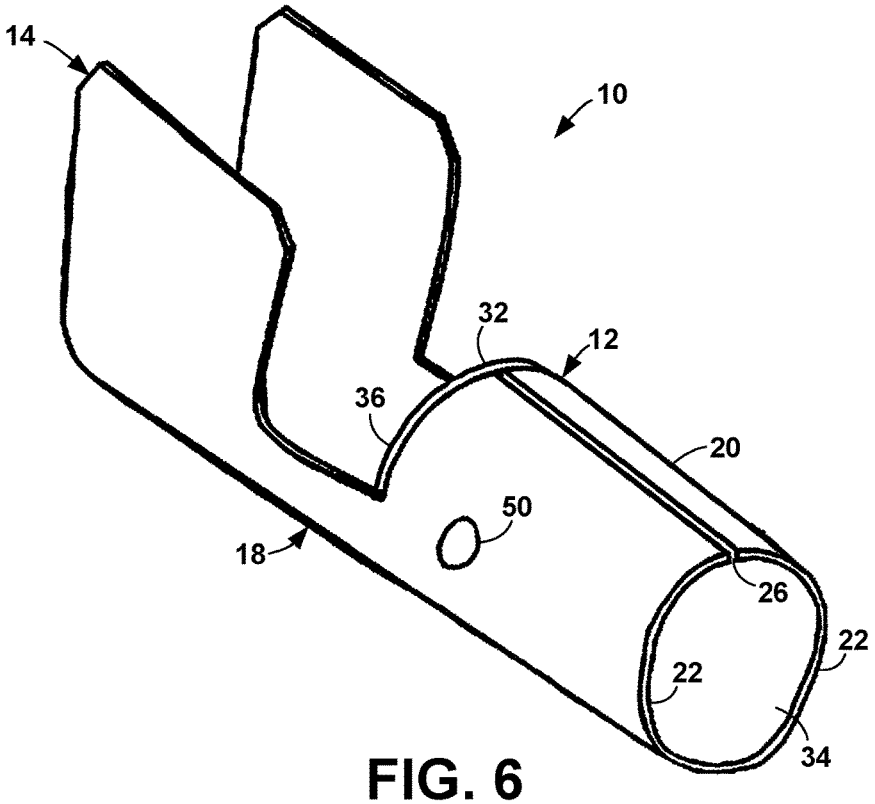
FIG. 6 is an isometric view of a straight connector of the present invention.

In the design of FIGS. 1-4, the jack 12 attaches to a spark plug terminal 2 at a 90° angle to the wire attachment 14. The present invention also contemplates that the jack 12 can be straight relative to the wire attachment 14, as shown in FIG. 6. The cap 36 can be formed as a round panel attached to one of the wings 22 and then bent over the end of the barrel 20. Alternatively, the cap 36 can be formed as a pair of semicircular panels, each attached to one of the wings 22. The two semicircular panels are bend toward each other so that they join to form a round cap. Optionally, the cap 36 can be tack-welded to the barrel 20 for a more stable configuration.

The barrel 20 has a pair of inwardly-extending dimples 50. Preferably, the dimples 50 are slightly oval in the direction tangential to the barrel 20, as in FIG. 3. Typically, the dimples 50 will be stamped into the connector blank 46. To acquire the oval shape, the dimples 50 can be stamped as ovals. Alternatively, the dimples 50 can be stamped as circles, such as shown in FIG. 5, and then stretched into ovals during the bending process. Optionally, the dimples 50 can be formed in other ways, such as molding into the blank 46.

The height 52 of the dimples 50 is in the range of from 40 mils to 50 mils. The width 54 of the dimples 50 is in the range of from 50 mils to 60 mils The depth 56 of the dimples 50 is in the range of from 7 mils to 12 mils.

The dimples 50 are not directly opposite each other, that is, are not 180° around the barrel 20 from each other. The larger angle 60 from the center of one dimple 50 to the other is in the range of from 190° to 220°, preferably about 200°. Optionally, the dimples 50 are located symmetrically from 95° to 110° around the barrel 20 from the seam 26, as in FIG. 4.

The inside diameter 38 of the barrel 20 and the diameter of the circle 62 formed by the two dimples 50 are sized to fit onto the spark plug terminal 2 such that the barrel expands slightly at the gap 24 and seam 26 to provide an inward radial pressure, as described below. To that end, the unexpanded inside barrel diameter 38 is in the range of from 253 mils to 257 mils and the diameter of the dimple circle 62 is in the range of from 229 mils to 243 mils.

When the jack 12 is installed on a spark plug terminal 2, the dimples 50 snap onto the taper 6. The distance 64 from the dimples 50 to the barrel closed end 32 is set to target the taper 6 just below the junction 7, as at 66 in FIG. 8. To that end, the distance 64 from the dimples 50 to the closed end 32 is slightly larger than the distance H from the spark plug terminal top 3 to the bulge/taper junction 7 and is in the range of from 150 mils to 160 mils. The dimples 50 are a distance O 68 from 10 mils to 30 mils below the bulge 4 so that they rest on the taper 6 just below the junction 7, with a preferred distance of about 15 mils to 30 mils, and a most preferred distance of about 20 mils.

Figure 8:
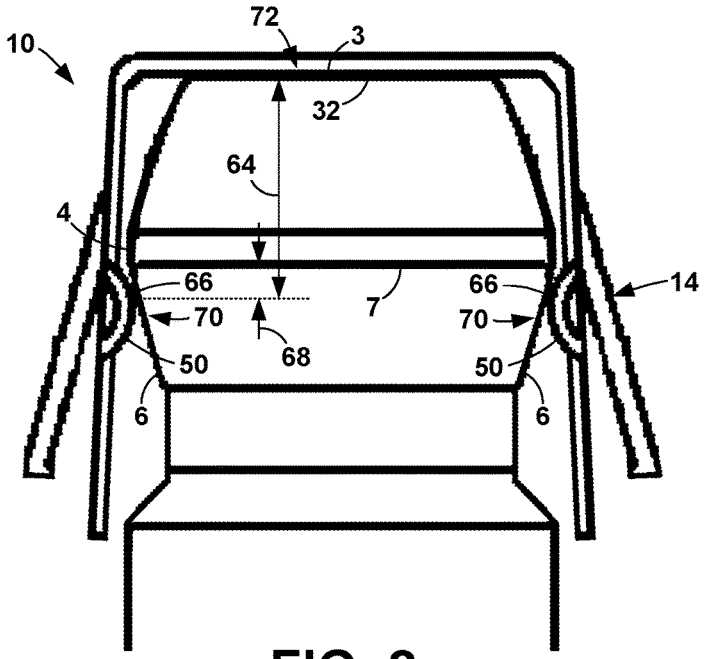
FIG. 8 is a front, cross-sectional view of the connector attached to a spark plug terminal showing three points of contact.
Figure 9:
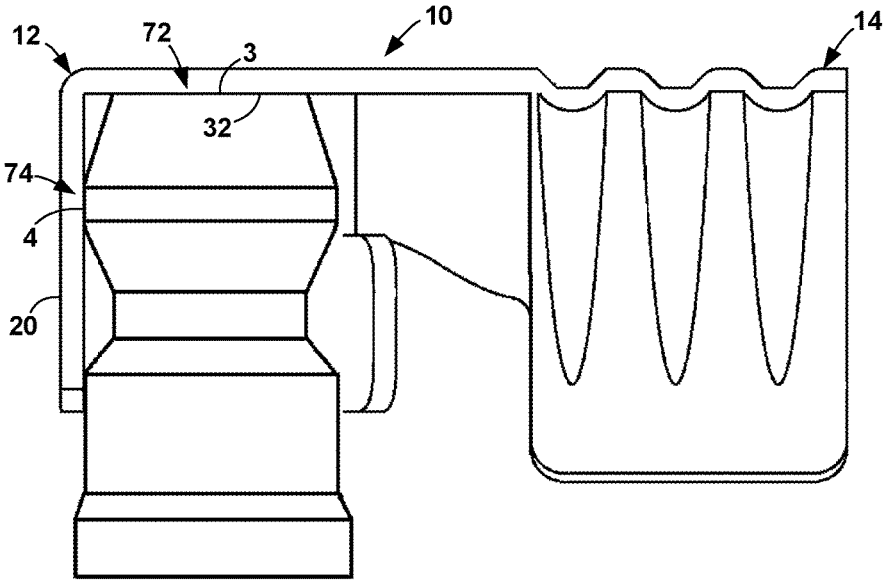
FIG. 9 is a side, cross-sectional view of the connector attached to a spark plug terminal showing two points of contact.

Because the diameter of the dimple circle 62 is smaller than the diameter at the location on the taper 6 that the dimples 50 contact, the barrel 20 cannot fully close when installed on the spark plug terminal 2, as seen in FIG. 8. Because the barrel 20 cannot close, the barrel 20 provides a constant inwardly-directed force against the spark plug terminal 2. Because of the particular locations of the dimples 50, this pressure maintains constant electrical contact between the jack 12 and the spark plug terminal 2 at at least four locations. The distance 64 from the closed end 32 to the dimples 50 causes pressure of the two dimples 50 against the taper 6, as at 70 in FIG. 8. The distance 64 from the closed end 32 to the dimples 50 causes pressure of the closed end 32 against the terminal top 3, as at 72 in FIGS. 8 and 9. The distance 64 from the closed end 32 to the dimples 50 and the angle 60 of the dimples from each other causes pressure of the barrel 20 farthest from the two dimples 50 against the bulge 4, as at 74 in FIG. 9. Having constant contact improves current flow efficiency, reduces electrical resistance that causes heat and radio frequency interference, all possibilities that engine vibration can introduce via a loose connection.

Thus it has been shown and described an ignition wire spark plug terminal. Since certain changes may be made in the present disclosure without departing from the scope of the present invention, it is intended that all matter described in the foregoing specification and shown in the accompanying drawings be interpreted as illustrative and not in a limiting sense.

The invention claimed is:

1. An ignition wire spark plug connector for a spark plug terminal having a top, a bulge with diameter D, a taper, and a top to taper height H, the connector comprising:

(a) a body composed of an electrically conductive material and having a wire attachment at one end and a jack at another end;

(b) the wire attachment adapted to electrically attach to a wire;

(c) the jack having a barrel with a closed end, an open end, and a generally cylindrical wall therebetween, the barrel having a central space with a diameter that is expandable and adapted to receive the spark plug terminal through the open end; and (d) at least two dimples extending into the central space from the cylindrical wall, the dimples being between 190° and 220° around the cylindrical wall from each other, and distance H plus 10 mils to 30 mils from the closed end;

(e) whereby, when the jack is installed on the spark plug terminal, the dimples fit on the taper just below the bulge, the cap abuts the terminal top, and the barrel expands thereby providing an inwardly-directed force to maintain electrical contact between the dimples and the taper.

2. The ignition wire spark plug connector of claim 1 wherein the jack is 90° relative to the wire attachment.

3. The ignition wire spark plug connector of claim 1 wherein the jack is straight relative to the wire attachment.

4. The ignition wire spark plug connector of claim 1 wherein the cylindrical wall has a paraxial seam extending between the closed end and open end to provide the expandable diameter.

5. The ignition wire spark plug connector of claim 4 wherein there are two dimples that are located symmetrically around the cylindrical wall 95° to 110° from the seam.

6. The ignition wire spark plug connector of claim 1 wherein the central space unexpanded diameter is in the range of from 253 mils to 257 mils and the dimples extend into the central space by a distance in the range of from 7 mils to 12 mils.

7. An ignition wire spark plug connector for a spark plug terminal having a top, a bulge with diameter D, a taper, and a top to taper height H, the connector comprising:

(a) a body composed of an electrically conductive material and having a wire attachment at one end and a jack at another end;

(b) the wire attachment adapted to electrically attach to a wire;

(c) the jack having a barrel with a closed end, an open end, a generally cylindrical wall therebetween, and paraxial seam extending between the closed end and open end, the barrel having a central space with an unexpanded diameter of from 253 mils to 257 mils that is expandable at the seam and adapted to receive the spark plug terminal through the open end; and (d) two dimples extending into the central space from the cylindrical wall by a distance in the range of from 7 mils to 12 mils, the dimples being located symmetrically around the cylindrical wall 95° to 110° from the seam, and distance H plus 10 mils to 30 mils from the closed end;

(e) whereby, when the jack is installed on the spark plug terminal, the dimples fit on the taper just below the bulge, the cap abuts the terminal top, and the barrel expands thereby providing an inwardly-directed force to maintain electrical contact between the dimples and the taper.

8. The ignition wire spark plug connector of claim 7 wherein the jack is 90° relative to the wire attachment.

9. The ignition wire spark plug connector of claim 7 wherein the jack is straight relative to the wire attachment.

* * * * *